US007462111B2

(12) United States Patent
Little

(10) Patent No.: US 7,462,111 B2
(45) Date of Patent: Dec. 9, 2008

(54) CONFIDENCE PUTTER

(76) Inventor: Daniel E. Little, c/o Little & Company, P.O. Box 35665, Richmond, VA (US) 23235-0665

( * ) Notice: Subject to any disclaimer, the term of this patent is extended or adjusted under 35 U.S.C. 154(b) by 106 days.

(21) Appl. No.: 11/100,405

(22) Filed: Apr. 7, 2005

(65) Prior Publication Data

US 2005/0227782 A1 Oct. 13, 2005

Related U.S. Application Data

(60) Provisional application No. 60/561,517, filed on Apr. 13, 2004, provisional application No. 60/619,000, filed on Oct. 18, 2004.

(51) Int. Cl.
*A63B 53/04* (2006.01)

(52) U.S. Cl. ..... 473/340; 473/325

(58) Field of Classification Search ..... 473/324–350
See application file for complete search history.

(56) References Cited

U.S. PATENT DOCUMENTS

| | | | | |
|---|---|---|---|---|
| 723,534 | A | 3/1903 | Knight | |
| 2,542,081 | A | 2/1951 | Hockey | |
| 4,664,385 | A * | 5/1987 | Macera | 473/340 |
| 5,324,031 | A * | 6/1994 | Green | 473/252 |
| 5,333,870 | A * | 8/1994 | Stevenson, Jr. | 473/251 |
| 5,728,009 | A | 3/1998 | Shanahan | |
| 5,749,793 | A | 5/1998 | Lucetti | |
| 5,795,246 | A | 8/1998 | Hale | |
| D399,897 | S | 10/1998 | Lu | |
| D410,980 | S | 6/1999 | Williams et al. | |
| 5,928,088 | A | 7/1999 | Matthews | |
| 6,019,686 | A * | 2/2000 | Gray | 473/313 |
| D430,246 | S | 8/2000 | Chiou et al. | |
| D434,819 | S | 12/2000 | Hoare | |
| D437,017 | S | 1/2001 | Ford | |
| D444,194 | S | 6/2001 | Calabro | |
| 6,241,624 | B1 * | 6/2001 | Zabytko et al. | 473/340 |
| 6,280,346 | B1 | 8/2001 | Gedeon | |
| D451,973 | S | 12/2001 | Wells et al. | |
| 6,340,336 | B1 | 1/2002 | Laconte | |
| 6,406,380 | B1 | 6/2002 | Jackson | |
| 6,428,424 | B2 | 8/2002 | Franco | |
| D464,098 | S | 10/2002 | Thalhammer | |
| 6,471,600 | B2 * | 10/2002 | Tang et al. | 473/242 |
| 6,485,375 | B1 | 11/2002 | McKinley | |
| 6,497,626 | B1 | 12/2002 | Sundberg | |
| 6,497,628 | B1 | 12/2002 | Gunderson | |

(Continued)

FOREIGN PATENT DOCUMENTS

JP 10015126 A * 1/1998

(Continued)

*Primary Examiner*—Gene Kim
*Assistant Examiner*—Alvin A Hunter
(74) *Attorney, Agent, or Firm*—L. Lawton Rogers, III

(57) ABSTRACT

A putter with a ball striking surface sufficiently large enough to inspire confidence that the ball will be struck within the sweet spot that is weighted to facilitate a pendulum putting stroke. The center of gravity of the putter head is higher than the center of gravity of a golf ball so that topspin is imparted to the golf ball when struck. Right and left hand putters are disclosed as are double-faced putters suitable for both. Methods of putter construction are also disclosed.

21 Claims, 6 Drawing Sheets

U.S. PATENT DOCUMENTS 6,520,865 B1 2/2003 Fioretti
D474,821 S 5/2003 Wells et al.
D475,102 S 5/2003 Flowers
D475,106 S 5/2003 Tang et al.
7,169,058 B1 * 1/2007 Fagan ..... 473/293
7,175,540 B2 * 2/2007 Sano ..... 473/332
2005/0209020 A1 * 9/2005 Burrows ..... 473/330

FOREIGN PATENT DOCUMENTS

JP 11057085 A * 3/1999

* cited by examiner 38a
44
38a 38a
44
42
42
40
38b
38b 48
46
48
38a 44
38a 50
52

CONFIDENCE PUTTER

RELATED APPLICATIONS

This application claims the priority of U.S. application Ser. No. 60/561,517 filed Apr. 13, 2004 and Ser. No. 60/619,000 filed Oct. 18, 2004.

BACKGROUND OF THE INVENTION

The present invention relates to a putter, and more specifically to a putter that provides a large golf ball striking surface to inspire confidence in the person putting and that is weighted to impart topspin to the golf ball to help keep the ball on line.

Fifty percent of the strokes in a par score are allotted to putting. No aspect of a golf game is more critical or frustrating. There are many putting techniques and hundreds of designs for putters. However, the single biggest factor remains confidence in making the putting stroke, i.e., confidence that the ball will be struck and that the golf ball will stay on the intended line once struck.

To insure that the surface of the putter will strike the golf ball within what is known as the "sweet spot" on the club face, the width of the ball striking face normal to the putting surface and to the desired line is generally quite large relative to the diameter of the golf ball. This permits some significant movement of the hands in and out during the putting stroke without imparting excessive "cut" or spin on the ball due to striking the golf ball off the centerline of the club.

However, the height of the ball striking face is generally only slightly larger that the diameter of the golf ball apparently on the theory that there is very little up and down movement of the hands during the putting stroke. In most cases, the height of the golf ball striking surface is less than the diameter of a golf ball to insure that the center of gravity ("COG") of the putter is below the COG of the golf ball.

One example of a putter with a wide but vertically short ball striking surface is shown in the Calabro U.S. Design Pat. No. D444,194 dated Jun. 6, 2001, and examples of short height ball striking surfaces are shown in the Wells Design U.S. Pat. No. D474,821 dated May 20, 2003 and the Ford U.S. Design Pat. No. D437,017 dated Jan. 30, 2001.

Other putters have attempted to insure hitting the golf ball in the sweet spot of the putter by focusing the attention of the golfer on the golf ball during the putting stroke. For example, the Franco U.S. Pat. No. 6,428,424 dated Aug. 6, 2002 shows a generally semicircular golf ball striking surface, i.e., flat on the bottom adjacent the green and curved to be approximately equidistance from the top and sides of the golf ball when the golf ball is addressed.

There have even been a few putters designed to impart topspin on the golf ball. For example, the lower half of the ball striking surface of the putter shown in the Laconte U.S. Pat. No. 6,340,336 dated Jan. 22, 2002 is removed to insure that the only contact of the surface with the golf ball is above the COG of the golf ball.

Still other putters have arced the golf ball striking surface of the putter to conform to the shape of the golf ball, thus providing an overhanging portion that tends to restrict the "hopping" of the golf ball when struck. One such putter is shown in the Fioretti U.S. Pat. No. 6,520,865 dated Feb. 18, 2003. Other putters of this general type are known as "mallet head" or bulbous putters. Such putter designs take mass from the width of the golf ball striking surface and add it behind the surface. One example of such a design is that shown in the U.S. Pat. No. 6,280,346 dated Aug. 28, 2001.

No known putter combines the characteristics of the putter of the present invention, preferred embodiments of which are hereinafter described in connection with the attached drawings.

THE DRAWINGS

FIGS. 5A-E are respectively front elevation, right side elevation, top plan, left side elevation and bottom plan views of a second embodiment of the present invention.

Figures 5A, 5B, 5C, 5D, 5E, 6:
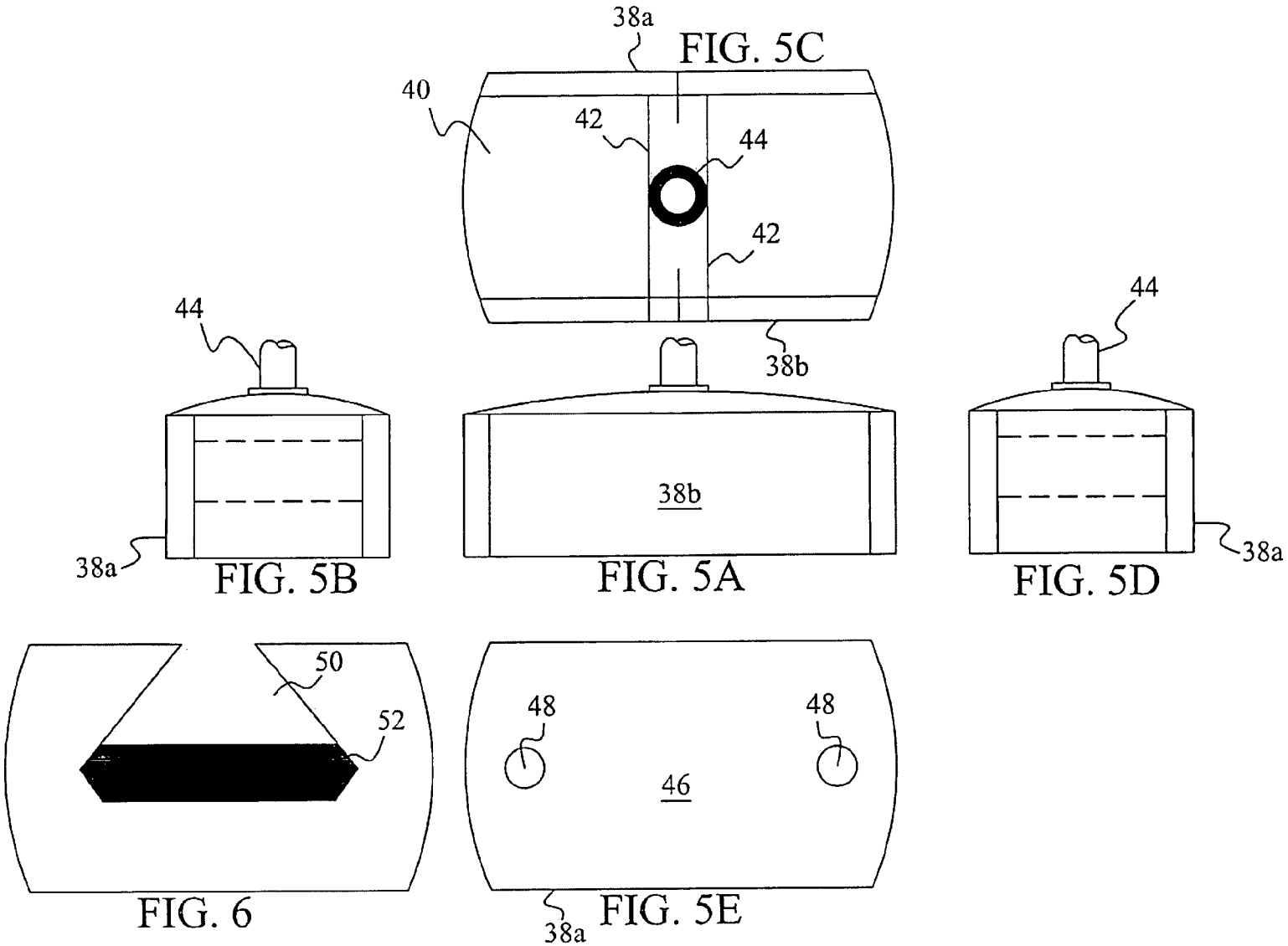

FIG. 6 is a horizontal section taken through the putter of FIG. 5 showing one method of construction.

Figure 7:
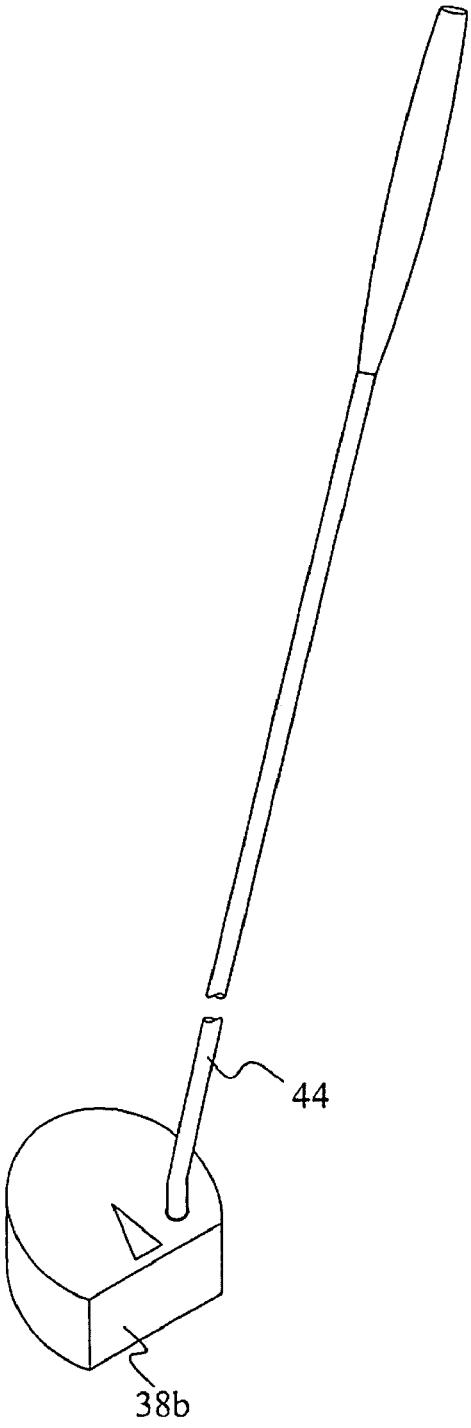

FIG. 7 is a pictorial view illustrating the location of the shaft of the putter of FIG. 5.

FIGS. 8A-E are respectively front elevation, right side elevation, top plan, left side elevation and bottom plan views of a third embodiment of the present invention.

Figure 9:
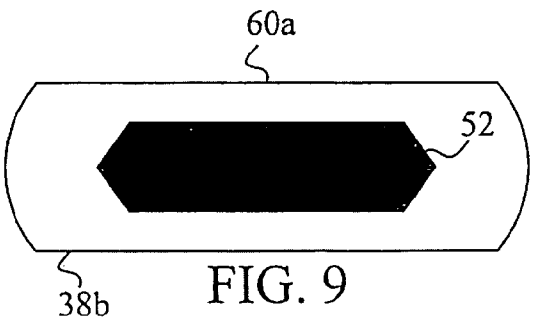

FIG. 9 is a horizontal section taken through the putter of FIG. 8 showing one method of construction.

Figure 10:
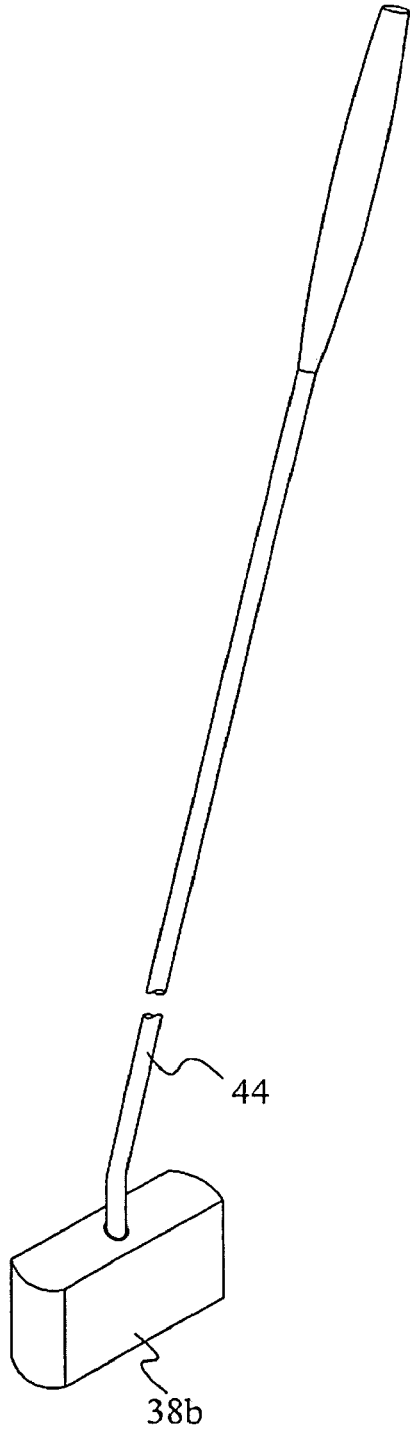
Figure 8D:
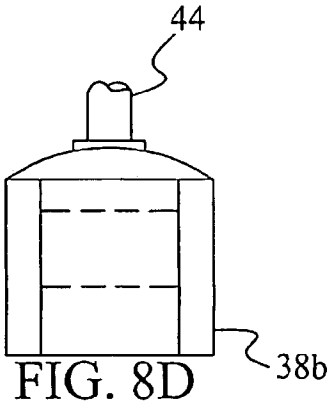
Figure 8C:
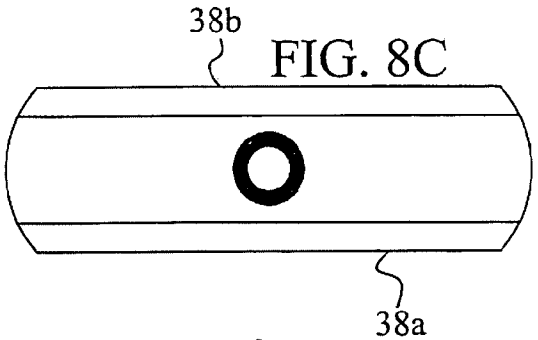
Figure 8A:
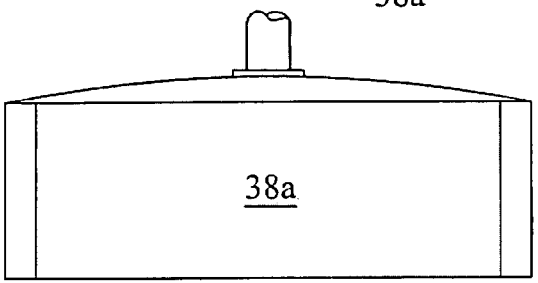
Figure 8E:
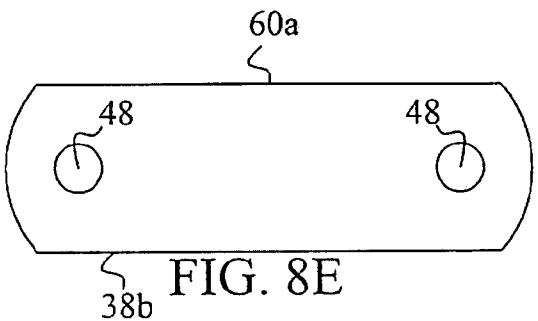
Figure 8B:
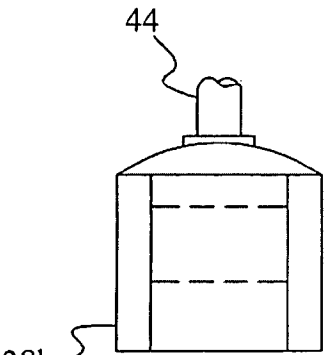

FIG. 10 is pictorial view illustrating the location of the shaft of the putter of FIGS. 8 and 9.

THE DETAILED DESCRIPTION

Figure 1:
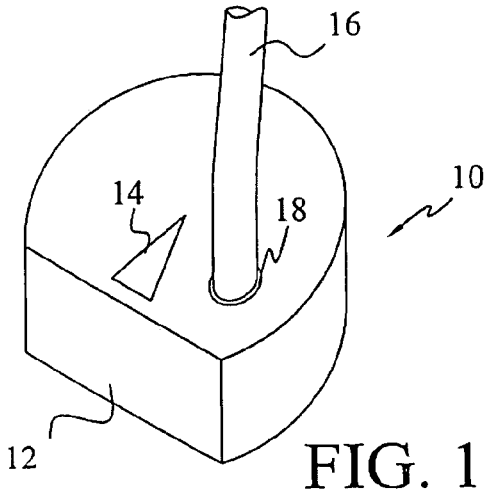
FIG. 1 is a pictorial view of one embodiment of the present invention.

With reference now to the figures where liked numerals are used to indicate like parts, one embodiment of the putter of the present invention is illustrated in FIG. 1. As shown in FIG. 1, the putter head 10 approximates the size and shape of a driver with the exception that the golf ball striking surface 12 is substantially vertical and does not have the eight to fifteen or more degrees of loft desirable for drivers and fairway woods. A ball alignment mark 14 may be scribed into or otherwise provided on the upper surface of the putter to aid in the alignment of the golfer with the desired path of the ball to the cup.

The shaft 16 is desirably inserted vertically into club head essentially parallel to the ball striking surface 12, and may be provided with a single angle bend appropriate to facilitate the griping of the shaft in a conventional putting stance, e.g., about 20 degrees at a point less than about 3" above the club head. The entry angle may be varied as needed for different putting stances, and the shaft 16 may be straight and enter the club head at an angle of about 20 degrees to the horizontal. A ferrule ring 18, preferably black, may be used to dress the entry of the shaft 16 into the top of the club head and any suitable conventional grip for the shaft 16 may be provided.

As shown in FIG. 2, the head of the putter may generally circular save for the ball striking surface 12. In the embodiment shown, the circle is approximately 4⅛" in diameter, and the striking surface is a flat area measuring approx. 3¼" horizontally across the face approximately 3⅜" from the rear of the head. The bottom 20 is substantially flat for movement along the green. As shown from the side views of FIGS. 2C and 2F, the maximum height of the club head is approximately 2⅛" at a point approximately ⅝ inch to the rear of the striking surface. The head slopes downwardly to a height of about 1¾" at the rear, about 2" at the striking surface, and slopes on the sides from about 2" at the striking surface to about 1¾" at the rear.

The shaft 16 enters the top of the club head approximately ¾" to the rear of the ball striking surface 12. The width of the head at the point of entry of the shaft is approximately 3½" and the point of entry of the shaft is approximately 25% of the width of the club at that point, or ⅞" from one side, depending on right/left hand use. In an alternative embodiment, the point of entry of the shaft 16 into the club head is centered left to right.

The preferred shaft is steel, about ⅜" in diameter. However, other conventional low torque materials such as graphite may be used. A typical club length (including shaft) is between 34" and 36", but other shaft lengths within USGA rules are contemplated.

Figure 3:
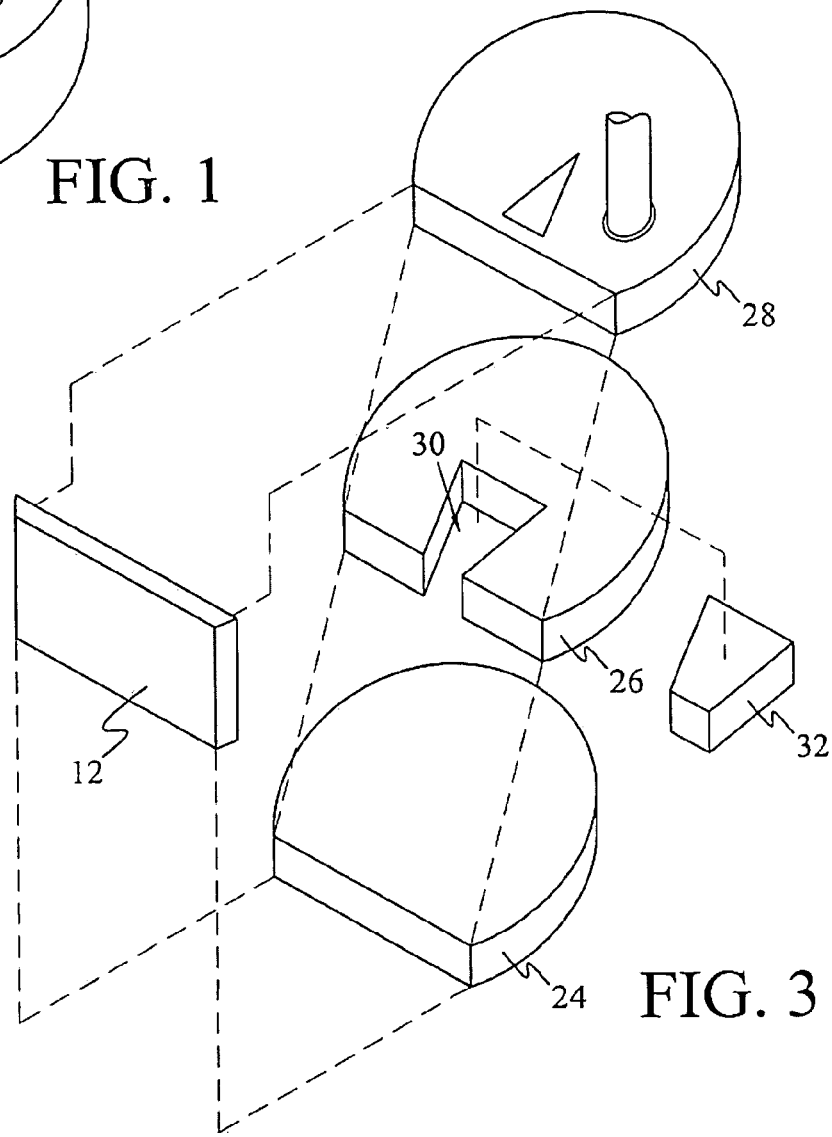
FIG. 3 is an exploded pictorial view of the putter of FIG. 1 showing one method of construction.
Figure 2C:
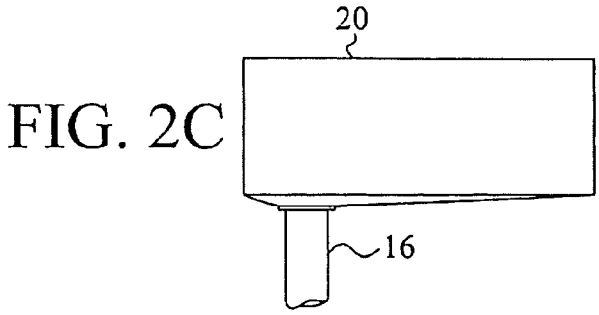
FIGS. 2A-2F are respectively top plan, front elevation, right side elevation, back elevation, left side elevation and bottom plan views of the embodiment of FIG. 1.
Figure 2B:
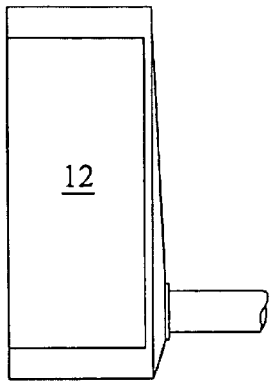
Figure 2A:
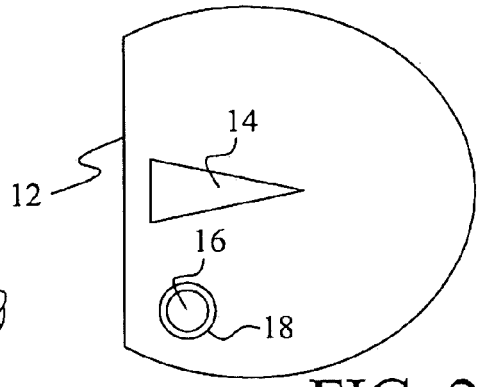
Figure 2D:
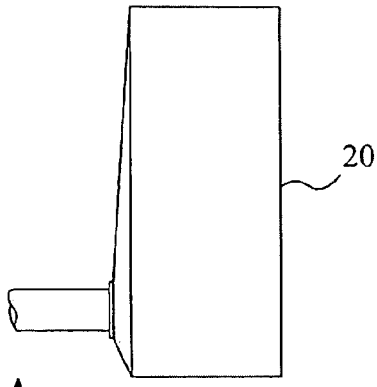
Figure 2F:
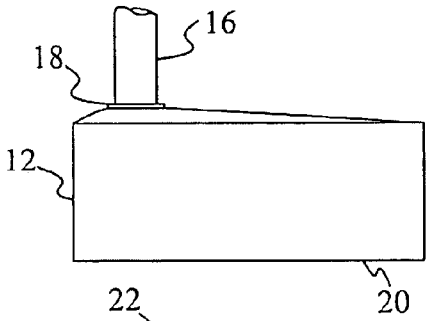
Figure 2E:
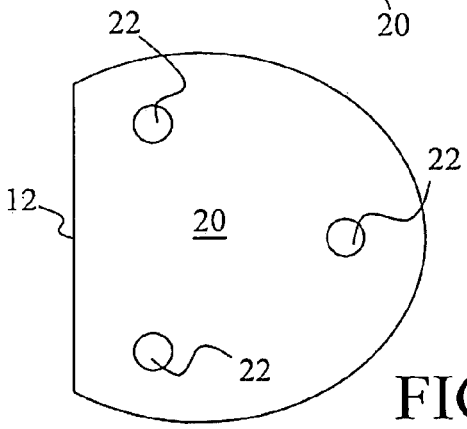

As shown in FIG. 3, a preferred embodiment may be fashioned from multiple individual pieces of hardwoods permanently laminated together to form the putter head, with the head shaped before or after lamination. As shown in FIG. 3, the three layers 24, 26 and 28 may be horizontal layers with dowels 22 (see FIG. 2F) of wood or other porous material extending upwardly from the bottom 20 of the club head to assist in securing the three layers. The preferred hardwoods are white poplar and red oak, but other durable hardwood such as maple and birch may be substituted. Alternatively, the layers of the putter head may be molded or otherwise shaped from a plastic or other material of suitable weight and strength, and a sole of metal of other suitable conventional material secured thereto by an adhesive or threaded fasteners.

The putter's ball striking surface 12 is preferably constructed of a single piece of red oak hardwood to provide durability and ball striking consistency. The ball striking surface 12 is desirably uniform across the width of the club, approximately ¼" in thickness, and the loft should not exceed about two degrees.

It is desirable that the club head be weighted and that the weight be rigidly secured to the head. Where the head is constructed from three substantially equal thickness layers as shown in FIG. 3, a preferred way is to accomplish the weighting is to create a generally triangular cavity 30 in the middle layer 26 with one apex pointed toward the ball striking surface 12 and open to the front of the club before the ball striking surface is added. A molten dense metal may thereafter be poured into the cavity created by the assembly of the three layers before the striking face is applied. Any suitable conventional method of creating the cavity 30 and inserting the weight 32 may be used, but in situ molding has been found desirable. In in situ molding, the pour may be interrupted before the cavity 30 is completely filled thus providing a truncated apex for the weight and an air space immediately behind the ball striking surface 12.

In a preferred embodiment, the weight 32 extends rearwardly approximately 1½" from the ball striking surface 12 and approximately ¾" to the rear of the axis of the shaft 16. The weight 32 desirably does not extend forwardly to the front plate that forms the ball striking surface, and may lie entirely to the rear of the point of entry of the shaft 16 into the club head. The resulting air space between the weight and the front plate contributes to the desired weight distribution and cushions the ball strike.

Figure 4:
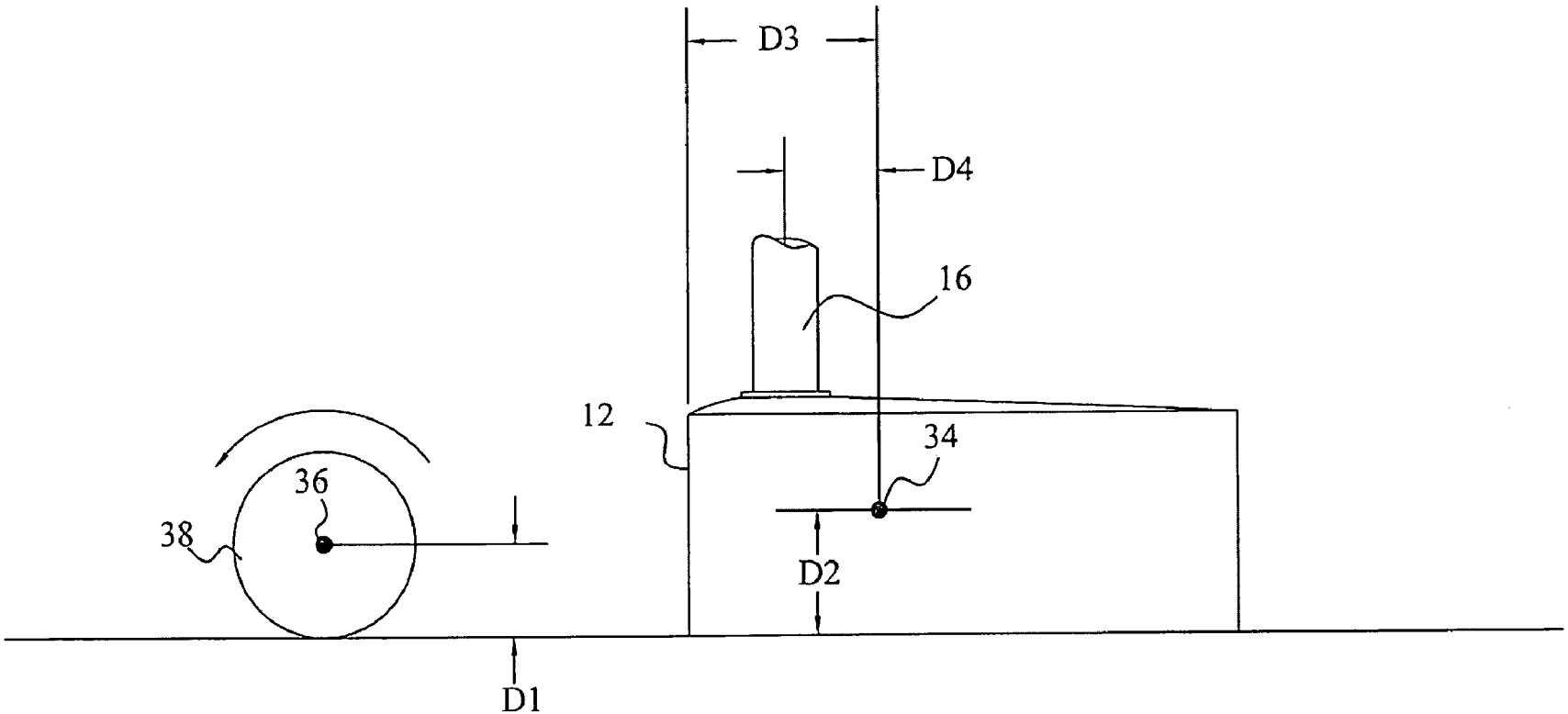
FIG. 4 is a pictorial view of the embodiment of FIG. 1 illustrating the topspin imparted to the golf ball when struck by the putter.

As shown in FIG. 4, The club head is internally weighted so that the COG 34 of the head is above the COG 36 of a golf ball 38 when the golf ball is addressed for putting. Currently, USGA approved golf balls must have a diameter of at least 1.60", which places the COG 36 of the golf ball a distance D1 of approximately 0.8" above the green. Thus, the distance D2 of the COG of the club head from the green is greater than the distance D1.

As also shown in FIG. 4, the COG 34 of the club head is also to the rear of the point where the shaft 16 enters the head, i.e., a point approximately 1¼" to the rear of the striking face and ½" to the rear of shaft in this embodiment. Thus, the distance D3 from the striking surface 12 and the COG 34 is greater than the distance D4 between the striking surface 12 and the point of entry of the shaft 15 into the club head.

A typical weight of the complete putter is 525 grams +/−40 grams, but this weight will of course vary with shaft length and the material used, particularly if the putter head is adapted for the mid-length and chest high putters. In this embodiment, the head weighs approximately 320 grams of which the weigh represents approximately 120 grams or approximately 35% to 40% of the weight of the head. The distribution of weight facilitates the striking of the golf ball with a pendulum motion. A positive topspin is imparted to the golf ball which enhances distance control and assists in keeping the ball on line.

The club head provides ease of visual alignment with the golf ball and its intended target line and is preferably finished in a high gloss natural wood color. Also facilitating the confidence of the golfer is the area of the ball striking surface relative to the size of the golf ball. The cross-sectional area of a golf ball measuring 1.60" in diameter is slightly in excess of 2 square inches. The ball striking surface in this embodiment is approximately 6.5 square inches, and thus provides a ratio of approximately 3:2 that is desirably maintained within ±10%.

A second embodiment of the putter of the present invention is shown in FIGS. 5-7. A significant difference from the embodiment of FIGS. 1-4 is the use of two putting faces or ball striking surfaces so that the putter may be used by both right-handed and left-handed golfers. In this two ball striking surface embodiment, it is desirable for the shaft 16 to be centered between the two surfaces 38*a* and 38*b* so that to impart a positive topspin to the golf ball when struck.

With reference to FIGS. 5-7, the putter head 40 is slightly smaller in size due to the two ball striking surfaces, but approximates the shape of a driver. The head may have ball alignment marks 42 provided on the upper surface of the putter to aid in the alignment of the golfer with the desired path of the ball to the cup. Where the shaft 44 is centered in the club head as shown in FIG. 5C, the directional marks 42 may pass approximate the width of and through the point where the shaft 44 enters the club head.

The shaft 16 is desirably inserted vertically into club head essentially parallel to the ball striking surfaces 38 as described in connection with the embodiment of FIG. 1-4. As shown in FIG. 2, the head of the putter may generally be circular save for the ball striking surfaces 38 with a width of approximately 4⅛", and a distance of 2¾" between the ball striking surfaces 38*a* and 38*b*. As shown in FIG. 5E, the bottom 46 is substantially flat for movement along the green. In this embodiment, the height of the club head is approximately 2" at the point of entry of the shaft 44, sloping downwardly to a height of about 1¾" at the striking surfaces 38.

The shaft may be as described in connection with the embodiment of FIGS. 1-4 and the club head may be similarly constructed of multiple pieces of hardwood permanently held together by upwardly extending dowels 48 (see FIG. 5E) of wood or other porous material, or suitable conventional threaded fasteners. Alternatively, the layers of the putter head and ball striking surfaces may be molded or otherwise shaped from a plastic or other material of suitable weight and strength, in which event the club head may be drilled and weighted, preferably from the bottom.

It is desirable that the club head be weighted and, where the head is constructed from three substantially equal thickness layers, a preferred way is to accomplish the weighting is, as shown in FIG. 6, to create a generally triangular cavity 50 in the middle layer with one apex pointed toward one of the ball striking surfaces 38 and open to either the front or back of the club before the ball striking surfaces are added. A molten dense metal may thereafter be poured into the cavity created by the assembly of the three layers before the ball striking surfaces are applied.

As in the embodiment of FIGS. 1-4, in situ molding has been found desirable with the cavity 50 shaped to provide front to back balance and to lock the weight 52 securely in place. The portion of the cavity 50 not filled with the weight 52 may be plugged with wood or a similar density material so as to maintain the same front to back weight distribution and balance.

As in the embodiment of FIGS. 1-4, the distribution of weight facilitates striking the golf ball with a pendulum motion to impart a positive topspin to the golf ball in the enhancement of distance control and in assistance in keeping the ball on line.

Facilitating the confidence of the golfer is the area of the ball striking surface relative to the size of the golf ball. The ball striking surfaces 38 in the embodiment of FIGS. 5-7 are desirably uniform across the width of the club and of the same size, i.e., approximately 6.5 square inches. This provides a ratio of approximately 3.2, desirably maintained within ±10%, between the surface area of the ball striking surfaces 38 and the cross-sectional area of the golf ball at its center.

A third embodiment of the putter of the present invention is shown in FIGS. 8-10 where like numerical designations have been used for elements common with the embodiment of FIGS. 5-7. As illustrated, the embodiment of FIGS. 8-10 differs principally from the embodiment of FIGS. 5-7 in that the front to back distance between the two ball striking surfaces 38*a* and 38*b* is reduced to about one inch. This reduction in the front to back dimension of he club head, keeping the overall size of the club head otherwise constant, slightly increasing both the size of the ball striking surfaces and the ratio of the area of such surfaces to the cross-sectional area of a golf ball at its center.

As shown in FIG. 9, the club head may be constructed as earlier described with the weight 52 locked in place and centered both front to back and side to side in the club head. As in the embodiments earlier described, the COG of the club head is higher than the COG of a golf ball and a positive topspin is imparted to the golf ball when impacted by the forwardly and upwardly swinging surface 38 in the putting stroke.

The club head of FIGS. 8 and 9 may be mounted to any suitable conventional shaft. For example, the shaft may be centered in the club head, enter the club head vertically and incorporate a bend of approximately twenty degrees as shown in FIG. 10. However, the shaft may be straight and may be of lengthened to facilitate use as a "belly" or "chest" putter, as desired.

As will be readily apparent, the large ball striking surface (s) of the putter of the present invention relative to the size of the golf ball give the golfer great confidence that the ball will be struck in the sweet spot of the club. The visual mass of the club is greater than most conventional putter heads, and the internal weight facilitates a pendulum swing favored by most golfers. The weighting of the club head naturally imparts a positive topspin to the golf ball when struck, and the confidence of the golfer in making the putting stroke will be enhanced by the improved tendency of the ball to remain on line.

While the foregoing is a description of preferred embodiments, many variations and modifications will naturally occur to those of skill in this art from a perusal hereof. The invention is therefore not to be limited to the embodiments disclosed, but defined only by the claims when accorded a full range of equivalents.

What is claimed is:

1. In a putter comprising a shaft and a head with a first golf ball striking surface, the improvement wherein the first ball striking surface is substantially planar, has an area no less than about 5 square inches, has a height no less than about 1.25 times a diameter of a golf ball, is inclined to vertical no more than about two degrees and where a center of gravity of the head is no less than a radius of the golf ball so that topspin is imparted to the golf ball when stuck by said first ball striking surface in a putting motion, said head including an internal weight and an air space between said weight and said first ball striking surface of said head.

2. The putter of claim 1, wherein most of said weight is located rearward of an entry point of said shaft into said head and higher above a sole of said club than the radius of a golf ball.

3. The putter of claim 1, wherein said shaft is attached to said head at a point vertically over said center of gravity of said head.

4. The putter of claim 1, wherein said head is provided with a second facing ball striking surface to rear of said first striking surface and spaced from said first ball striking surface.

5. The putter of claim 4, wherein said second surface is generally planar and is of the same size as said first ball striking surface, and wherein both of said surfaces are inclined to the horizontal no more than about two degrees.

6. The putter of claim 4, wherein a height of both of said surfaces are approximately twice the diameter of a golf ball.

7. The putter of claim 1, wherein said shaft is attached to said head such that said shaft is laterally centered with respect to said head.

8. The putter of claim 1, wherein said head comprises:

three horizontal layers of substantially equal thickness;

a surface layer of substantially uniform thickness carried by forward facing ends of said three layers with an exposed forward facing surface of said surface layer forming said golf ball striking surface, said weight being carried internally of said head in the middle one of said three layers.

9. The putter of claim 8, wherein said weight is generally triangular in horizontal cross-section with one apex facing said surface layer and centered with respect to said ball striking surface.

10. The putter of claim 8, wherein said weight is permanently embedded in a cavity said middle layer and spaced from a rear side of said forward facing surface of said surface layer.

11. The putter of claim 8, wherein the center of gravity of said head is vertically higher than a midpoint of said ball striking surface and said surface layer being no less than about 0.25 inches in thickness.

12. In a putter comprising a shaft and a head with a first golf ball striking surface, the improvement wherein said first ball striking surface is substantially planar, has an area no less than about 5 square inches, has a height no less than about 1.25 times a diameter of a golf bail, is inclined to vertical of no more than about two degrees and where a center of gravity of the head is no less than a radius of the golf ball so that topspin is imparted to the golf ball when struck by said first ball striking surface in a putting motion, said head including an internal weight and said weight being generally triangular in a horizontal cross-section with one apex centered with respect to said first striking surface and facing forward toward said first ball striking surface of said head.

13. The putter of claim 12, wherein the forward facing apex of said weight is truncated.

14. The putter of claim 12, wherein said shaft is attached to said head at a point vertically over said center of gravity of said head.

15. The putter of claim 12, wherein said head is provided with a second facing ball striking surface to rear of said first ball striking surface and spaced from said first ball striking surface.

16. The putter of claim 12, wherein said second surface is generally planar and is of the same size as said first ball striking surface, and wherein both of said surfaces are inclined to the horizontal no more than about two degrees.

17. The putter of claim 16, wherein a height of both of said surfaces is approximately twice the diameter of the golf ball.

18. The putter of claim 12, wherein said shaft is attached to said head such that said shaft is laterally centered with respect to said head.

19. The putter of claim 12, wherein said head comprises: three horizontal layers of substantially equal thickness;

a surface layer of substantially uniform thickness carried by forward facing ends of said three layers with an exposed forward facing surface of said surface layer forming said golf ball striking surface;

said weight being carried internally of said head in the middle one of said three layers.

20. The putter of claim 19, wherein said weight is generally triangular in horizontal cross-section with one apex facing said surface layer and centered with respect to said ball striking surface.

21. The putter of claim 19, wherein said weight is permanently embedded in a cavity in said middle layer and spaced from a rear side of said forward facing surface of said surface layer.

* * * * *

UNITED STATES PATENT AND TRADEMARK OFFICE

CERTIFICATE OF CORRECTION

PATENT NO. : 7,462,111 B2
APPLICATION NO. : 11/100405
DATED : December 9, 2008
INVENTOR(S) : Daniel E. Little It is certified that error appears in the above-identified patent and that said Letters Patent is hereby corrected as shown below:

Title page, item [75] Danicl E. Little should read as Daniel E. Little.

Signed and Sealed this
Twenty-first Day of February, 2012

David J. Kappos

David J. Kappos
*Director of the United States Patent and Trademark Office*